US011109648B1

(12) United States Patent
Crawford

(10) Patent No.: US 11,109,648 B1
(45) Date of Patent: Sep. 7, 2021

(54) BUCKLE

(71) Applicant: John Crawford, Canton, NC (US)

(72) Inventor: John Crawford, Canton, NC (US)

(73) Assignee: Microtech Knives, Inc., Mills River, NC (US)

( * ) Notice: Subject to any disclaimer, the term of this patent is extended or adjusted under 35 U.S.C. 154(b) by 0 days.

(21) Appl. No.: 17/176,736

(22) Filed: Feb. 16, 2021

(51) Int. Cl.
*A44B 11/25* (2006.01)
*A44B 11/26* (2006.01)

(52) U.S. Cl.
CPC ..... *A44B 11/266* (2013.01); *A44B 11/2592* (2013.01)

(58) Field of Classification Search
CPC ..... A44B 11/266; A44B 11/2592
See application file for complete search history.

(56) References Cited

U.S. PATENT DOCUMENTS 4,217,681 A * 8/1980 Grohoski ..... A44C 5/14 224/164
5,311,649 A * 5/1994 Suh ..... A44B 11/266 24/625
8,464,407 B2 * 6/2013 Von Der Ahe ..... A44B 11/2519 24/634
8,572,820 B2 * 11/2013 Richards ..... A44B 11/2519 24/634
9,173,454 B2 * 11/2015 Liu ..... A44B 11/006
9,578,929 B2 * 2/2017 Hung ..... A44B 11/2546
10,123,591 B2 * 11/2018 Angelini ..... B63C 11/30
10,617,180 B1 * 4/2020 Yen ..... A44B 11/06
2002/0040515 A1 4/2002 Uehara et al.
2009/0013510 A1 * 1/2009 Liang ..... A44B 11/266 24/648
2011/0162177 A1 7/2011 Von Der Ahe et al.
2012/0091867 A1 * 4/2012 Bouwman ..... E05D 11/1014 312/116
2012/0124790 A1 5/2012 Richards
2013/0160251 A1 * 6/2013 Kawaguchi ..... A44B 11/2546 24/594.11
2013/0192033 A1 * 8/2013 Hortnagl ..... A44B 11/2519 24/633
2014/0215766 A1 * 8/2014 Liu ..... A44B 11/006 24/188
2014/0298630 A1 * 10/2014 Hortnagl ..... A44B 11/2519 24/697.2
2015/0305449 A1 * 10/2015 Kranzlein ..... A44B 11/25 2/322
2015/0351500 A1 * 12/2015 Kolasa ..... A44B 11/2592 24/615

(Continued)

*Primary Examiner* — Jason W San
(74) *Attorney, Agent, or Firm* — Steve LeBlanc, LLC

(57) ABSTRACT

A buckle includes a tab having a first side opposed to a second side and a receiver having a first side opposed to a second side. A first pair of pawls is pivotally connected to the first side of the tab. A cavity is defined in the receiver between the first and second sides of the receiver and configured to receive the first and second sides of the tab. The first pair of pawls has a locked position in which the first pair of pawls is engaged with the receiver to prevent movement of the tab with respect to the receiver and a released position in which the first pair of pawls permits movement of the tab with respect to the receiver. A first button on the first side of the receiver has a released position that moves the first pair of pawls to the released position.

20 Claims, 7 Drawing Sheets

(56) References Cited

U.S. PATENT DOCUMENTS

| | | | | |
|---|---|---|---|---|
| 2016/0150857 | A1* | 6/2016 | Botkus | A44B 11/2592 24/615 |
| 2018/0125171 | A1* | 5/2018 | Zhang | A44B 11/2592 |
| 2018/0289113 | A1* | 10/2018 | Chu | A44B 11/266 |
| 2019/0037973 | A1 | 2/2019 | Nanbu | |
| 2019/0116939 | A1 | 4/2019 | Porto et al. | |
| 2019/0183212 | A1 | 6/2019 | Sun | |
| 2019/0289967 | A1 | 9/2019 | Lin | |
| 2020/0022463 | A1* | 1/2020 | Templeton | A44B 11/2592 |
| 2020/0069003 | A1* | 3/2020 | Chu | A44B 11/266 |
| 2020/0178652 | A1* | 6/2020 | Ma | A44B 11/2592 |
| 2020/0205528 | A1 | 7/2020 | Yoshie | |
| 2020/0260824 | A1* | 8/2020 | Moran | A44B 17/0005 |
| 2020/0329825 | A1 | 10/2020 | Kuo et al. | |
| 2020/0359761 | A1 | 11/2020 | Paik et al. | |
| 2020/0397098 | A1 | 12/2020 | Paik et al. | |
| 2021/0000223 | A1 | 1/2021 | Redman et al. | |
| 2021/0001803 | A1 | 1/2021 | Bunin | |
| 2021/0015217 | A1 | 1/2021 | Cheng et al. | |

* cited by examiner

BUCKLE

FIELD OF THE INVENTION

The present invention generally involves a buckle. In particular embodiments, the buckle may be connected to webbing, straps, belts, or other similar materials to provide a reliable, releasable coupling.

BACKGROUND OF THE INVENTION

Many buckle designs exist to releasably couple one article to another, and the particular design for any buckle balances multiple and often competing design goals. For example, reliability and ease of operation are desirable design goals for every buckle. However, particular buckle applications may value the strength of the coupling and/or resistance to inadvertent release of the coupling over speed and ease of operation. Other particular buckle applications may value speed and ease of operation over strength of the coupling and/or resistance to inadvertent release of the coupling. Therefore, the need exists for an improved buckle that provides a strong coupling and is resistant to inadvertent release without compromising the speed and ease of operation of the buckle.

BRIEF DESCRIPTION OF THE INVENTION

Aspects and advantages of the invention are set forth below in the following description, or may be obvious from the description, or may be learned through practice of the invention.

One embodiment of the present invention is a buckle that includes a tab having a first side opposed to a second side and a receiver having a first side opposed to a second side. A first pair of pawls is pivotally connected to the first side of the tab. A cavity is defined in the receiver between the first and second sides of the receiver and configured to receive the first and second sides of the tab. The first pair of pawls has a locked position in which the first pair of pawls is engaged with the receiver to prevent movement of the tab with respect to the receiver and a released position in which the first pair of pawls permits movement of the tab with respect to the receiver. A first button on the first side of the receiver has a released position that moves the first pair of pawls to the released position.

An alternate embodiment of the present invention is a buckle that includes a tab, a first pair of pawls pivotally connected to the tab, and a second pair of pawls pivotally connected to the tab. A receiver defines a cavity to receive the tab, and the tab and the receiver have a locked position in which the first and second pairs of pawls engage with the receiver to prevent movement of the tab with respect to the receiver and a released position in which the first and second pairs of pawls permit movement of the tab with respect to the receiver. A plurality of buttons on the receiver has a released position that moves the first and second pairs of pawls to the released position.

In yet another embodiment of the present invention, a buckle includes a tab and a plurality of pawls pivotally connected to the tab. A receiver defines a cavity to receive the tab, and the tab and the receiver have a locked position in which each pawl of the plurality of pawls engages with the receiver to prevent movement of the tab with respect to the receiver and a released position in which each pawl of the plurality of pawls permits movement of the tab with respect to the receiver. A plurality of buttons on the receiver has a released position that moves each pawl of the plurality of pawls to the released position.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
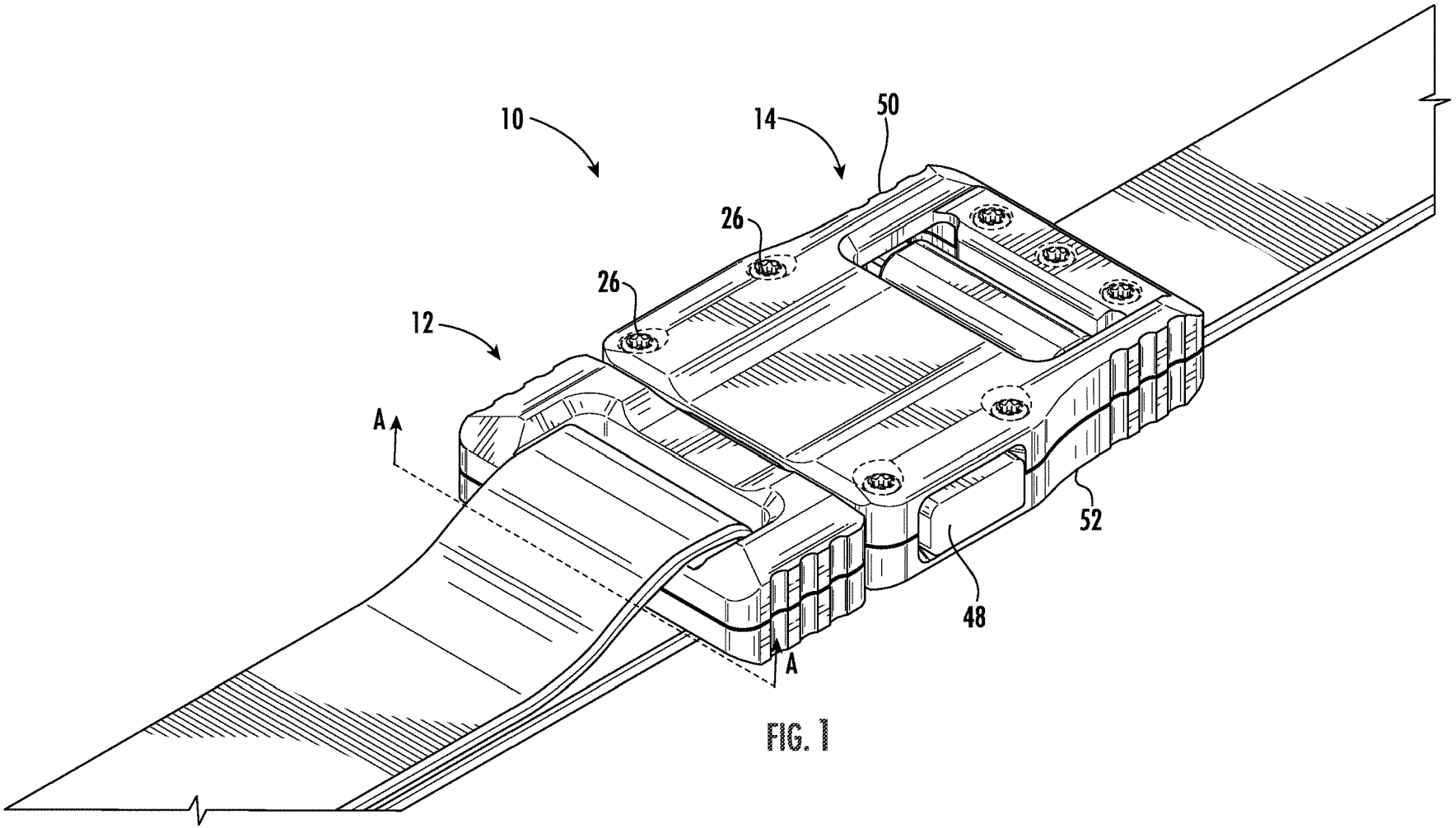
FIG. 1 is a top perspective view of a buckle according to one embodiment of the present invention in a locked position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
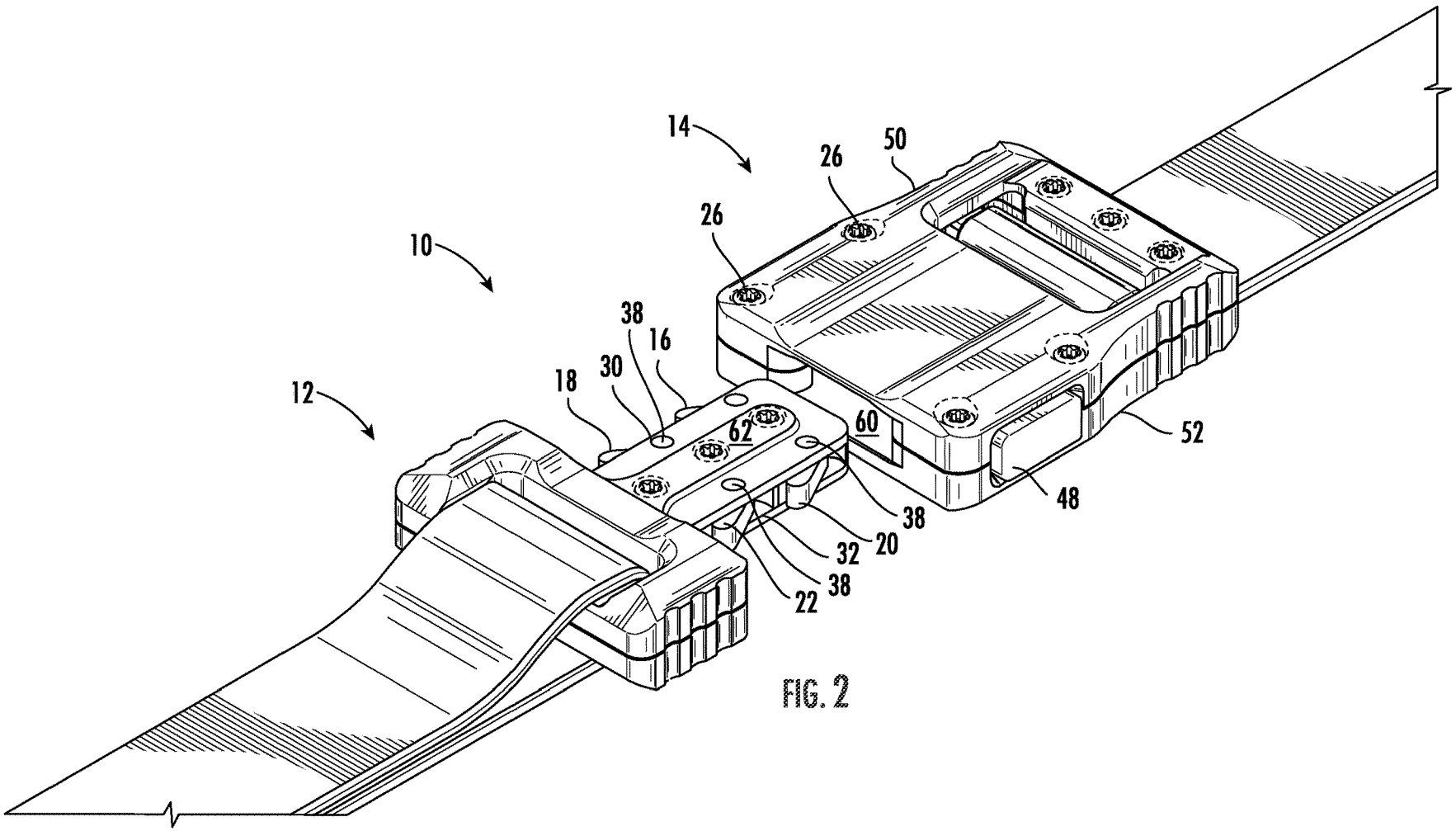
FIG. 2 is a top perspective view of the buckle shown in FIG. 1 in a released position.
Figure 3:
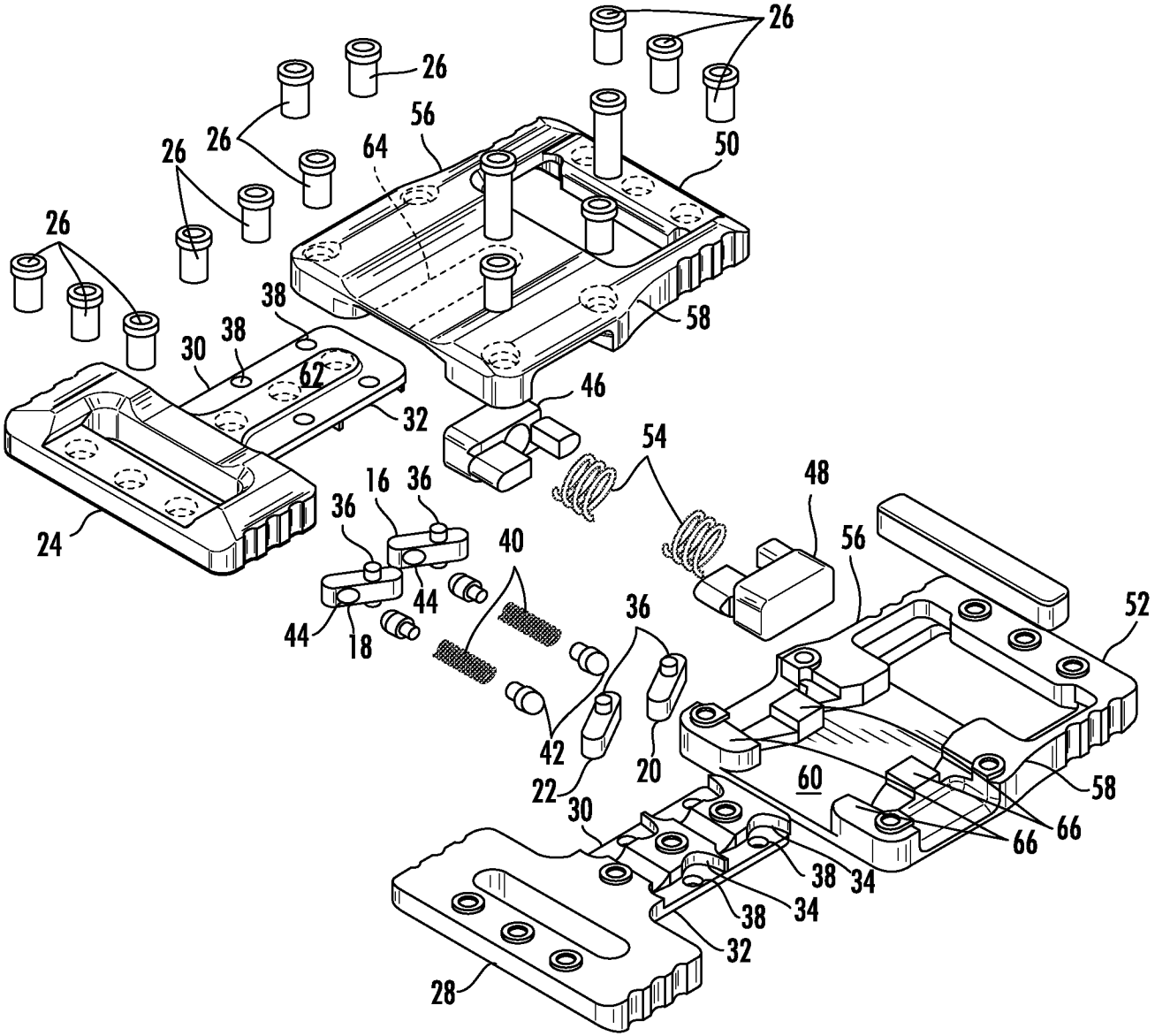
FIG. 3 is an exploded view of the buckle shown in FIG. 2.

Embodiments of the present invention include a buckle 10 having redundant locking and release mechanisms that enhance the strength and reliability of the buckle 10 without compromising speed and ease of operation. FIGS. 1 and 2 provide top perspective views of the buckle 10 according to one embodiment of the present invention in a locked and released position, respectively. FIG. 3 provides an exploded view of the buckle 10 shown in FIG. 2.

As shown in FIGS. 1-3, the buckle 10 generally includes a tab 12 configured to slide into and releasably lock with a receiver 14. The tab 12 may be formed from two pieces connected together to sandwich a locking mechanism inside the tab 12. For example, the locking mechanism may include a plurality of pawls 16, 18, 20, 22, and the tab 12 may include a cover 24 connected by screws 26 to a chassis 28 to sandwich the plurality of pawls 16, 18, 20, 22 inside the tab 12. Each pawl 16, 18, 20, 22 has a locked position and a released position. In the locked position, the pawl is engaged with the receiver 14 to prevent movement of the tab 12 with respect to the receiver 14. In the released position, the pawl permits movement of the tab 12 with respect to the receiver 14. The pawls 16, 18, 20, 22 may be arranged in or referred to as "pairs of pawls," and depending on the particular context, a pair of pawls may refer to two pawls on the same side of the tab 12 (e.g., pawls 16 and 18 or pawls 20 and 22) or two pawls on opposite sides of the tab 12 (e.g., pawls 16 and 20 or pawls 18 and 22).

The tab 12 generally has a first side 30 opposed to a second side 32 and may further define a plurality of pockets 34 to receive the pawls 16, 18, 20, 22. As shown most clearly in FIG. 3, each pawl 16, 18, 20, 22 may include a post 36 that fits into a complementary recess 38 in the cover 24 and chassis 28 so that the pawls 16, 18, 20, 22 are pivotally connected to the tab 12. A pawl spring 40 between adjacent pawls on the first and second sides 30, 32 of the tab 12 (e.g., pawls 16 and 20 or pawls 18 and 22) may bias the adjacent pawls away from one another. Each pawl spring 40 may be in direct contact with the adjacent pawls. Alternately, a piston on each end of each pawl spring 40 may fit in a corresponding recess 44 in each pawl to enhance the connection between the pawl spring 40 and adjacent pawls. As shown in FIG. 3, for example, a male piston 42 may engage with a complementary female piston 43 within the pawl spring 40 so that the male and female pistons 42, 43 reciprocate as the pawl spring 40 is compressed and relaxed during operation of the locking mechanism. In this manner, the male and female pistons 42, 43 enhance alignment of each pawl spring 40 during operation.

The receiver 14 may similarly be formed from two pieces connected together to sandwich a release mechanism inside the receiver 14. For example, the release mechanism may include a plurality of buttons 46, 48, and the receiver 14 may include a cover 50 connected by screws 20 to a chassis 52 to sandwich the plurality of buttons 46, 48 inside the receiver 14. Each button 46, 48 has a released position that moves a pair of pawls (e.g., pawls 16 and 18 or pawls 20 and 22) to the released position. A button spring 54 may be engaged with each button 46, 48 to bias the buttons 46, 48 away from each other and/or from the pawls 16, 18, 20, 22.

The receiver 14 generally has a first side 56 opposed to a second side 58 and defines a cavity 60 between the first and second sides 56, 58 of the receiver 14. The cavity 60 is configured to receive the first and second sides 30, 32 of the tab 12. As shown in FIG. 3, the tab 12 may further include a projection 62 between the first and second sides 30, 32 of the tab 12, and the receiver 14 may define a complementary recess 64 (shown in phantom) to receive the projection 62 on the tab 12 to facilitate proper alignment of the tab 12 inside the cavity 60 of the receiver 14. The receiver 14 may further define a plurality of detent surfaces 66 that interact with the pawls 16, 18, 20, 22 while the buckle 10 is being locked and engage with the pawls 16, 18, 20, 22 when the buckle 10 is in the locked position. The detent surfaces 66 generally operate in pairs against adjacent pawls (e.g., pawls 16 and 20 or pawls 18 and 22), and depending on the particular context, a pair of detent surfaces 66 may refer to two detent surfaces 66 on the same side of the receiver 14 or two detent surfaces 66 on opposite sides of the receiver 14.

Figure 4:
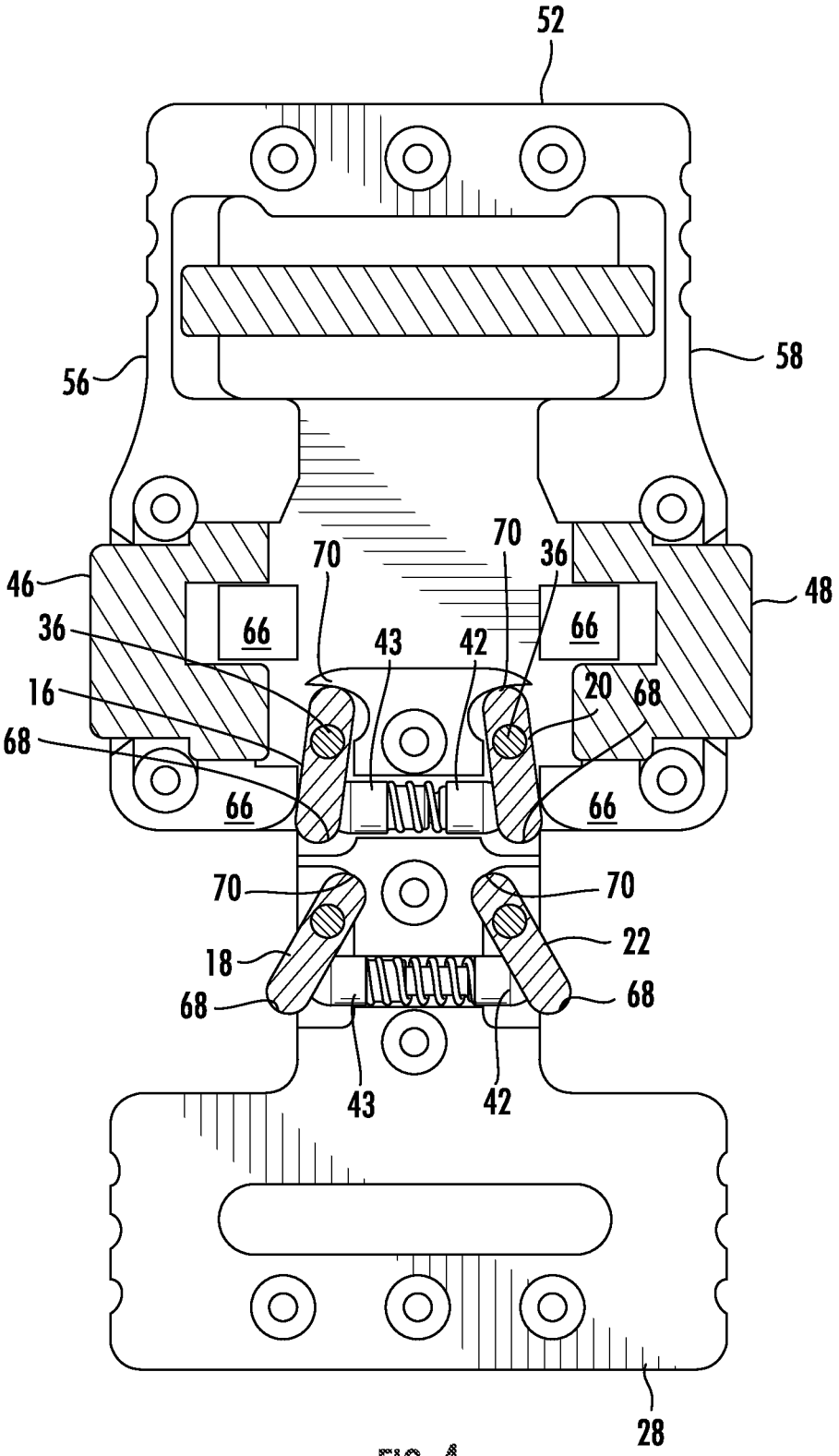
FIG. 4 is a cross-section view of the buckle shown in FIG. 1 taken along A-A while being locked.
Figure 5:
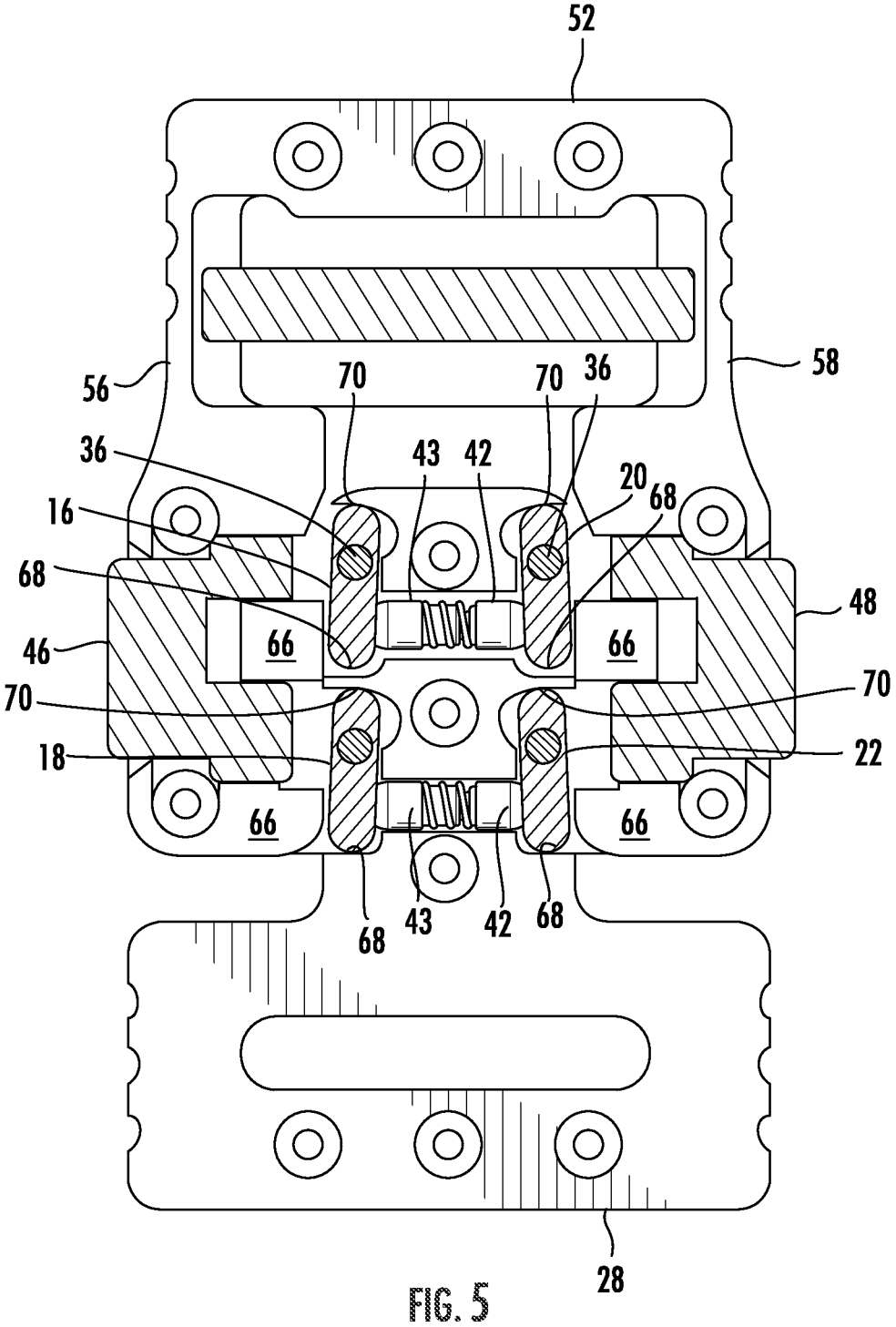
FIG. 5 is a cross-section view of the buckle shown in FIG. 1 taken along A-A while being locked.

Operation of the buckle 10 between the released and locked positions will now be described with respect to FIGS. 4-7. FIGS. 4 and 5 provide cross-section views of the buckle 10 shown in FIG. 1 taken along A-A while being locked. As the tab 12 is progressively inserted into the cavity 60, successive pairs of detent surfaces 66 progressively slide against the first pair of pawls 16, 20 (as shown FIG. 4) and then the second pair of pawls 18, 22 (as shown in FIG. 5) to overcome the bias provided by the pawl springs 40 and pivot each pawl 16, 18, 20, 22 into its respective pocket 34. As the tab 12 is inserted further into the cavity 60, each pawl 16, 18, 20, 22 eventually clears the adjacent detent surface 66, allowing the pawl springs 40 to again force the adjacent pawls away from one another and pivot each pawl 16, 18, 20, 22 out of its respective pocket 34.

Figure 6:
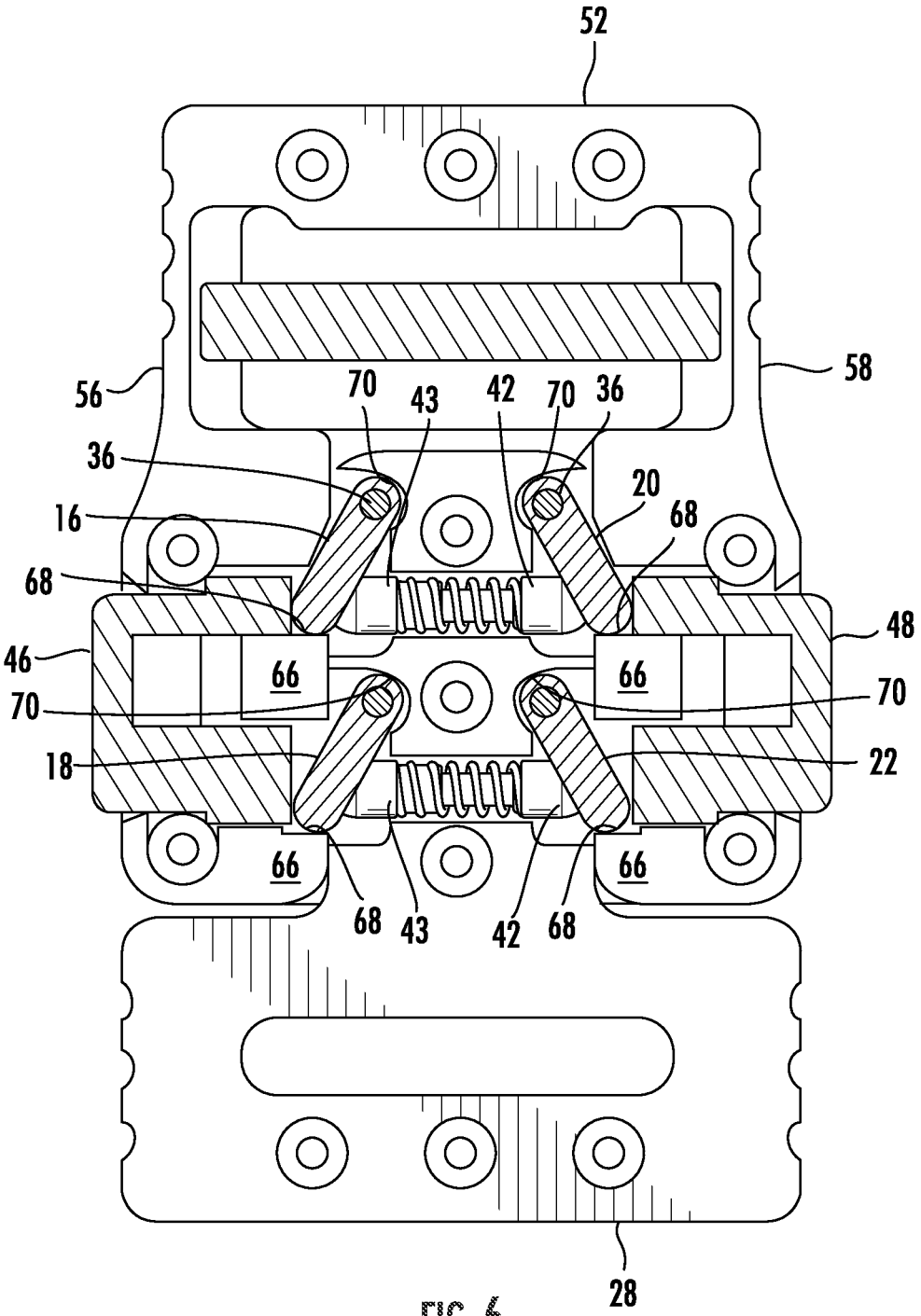
FIG. 6 is a cross-section view of the buckle shown in FIG. 1 taken along A-A while in the locked position.

FIG. 6 provides a cross-section view of the buckle 10 shown in FIG. 1 taken along A-A while in the locked position. In the locked position, a first end 68 of each pawl 16, 18, 20, 22 is engaged with a detent 66 of the receiver 14, and a second end 70 of each pawl is engaged with a recess 38 of the tab 12. As a result, each pawl 16, 18, 20, 22 independently and redundantly prevents movement of the tab 12 with respect to the receiver 14 to securely hold the buckle 10 in the locked position. In addition, additional load placed on the buckle 10 in the locked position further seats each pawl 16, 18, 20, 22 in the locked position against the tab 12 and receiver 14, strengthening the locking force provided by each pawl without increasing the stress on the post 36 for any pawl, and further reducing the chance of an inadvertent release of any pawl.

Figure 7:
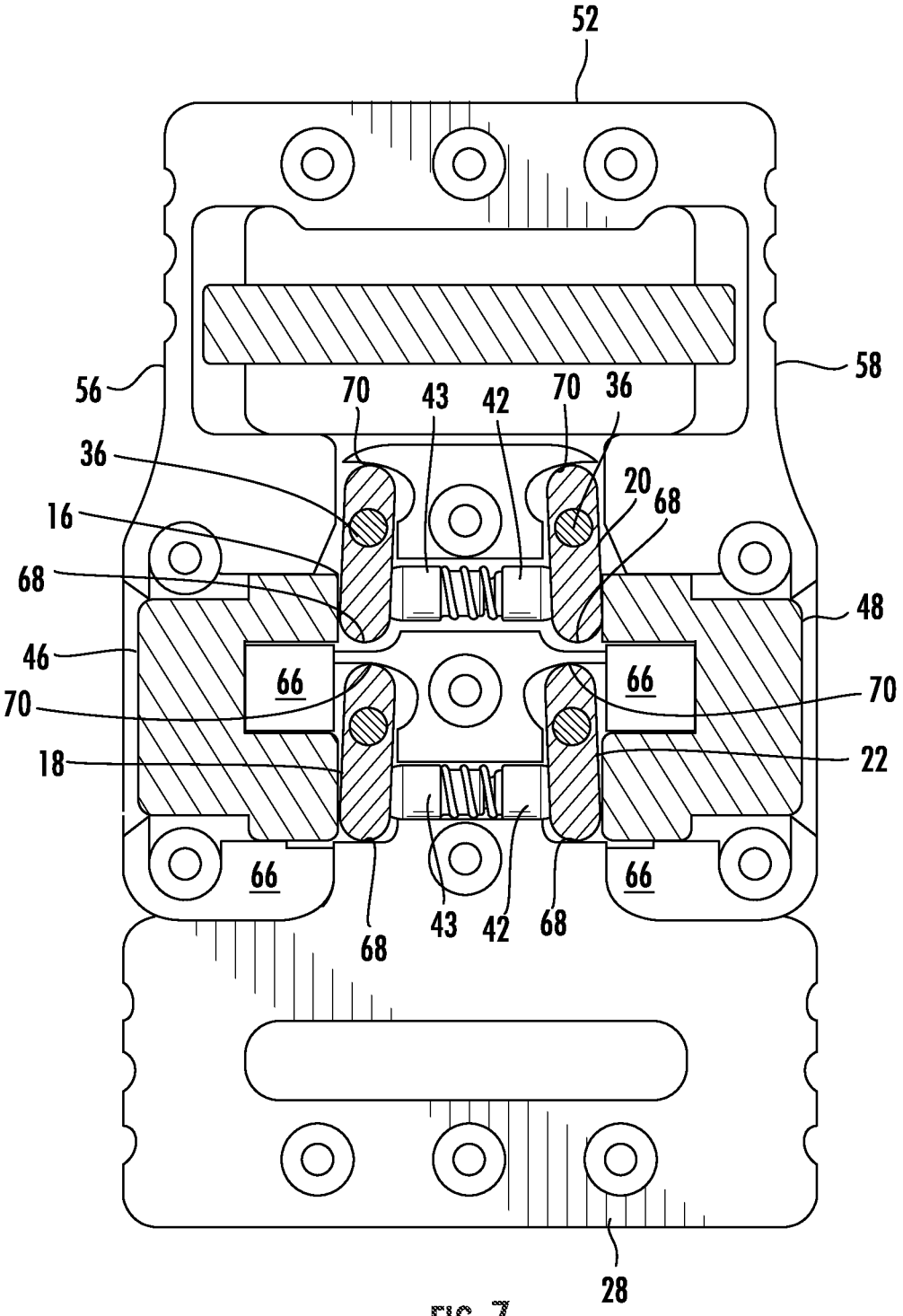
FIG. 7 is a cross-section view of the buckle shown in FIG. 1 taken along A-A while being released.

FIG. 7 provides a cross-section view of the buckle 10 shown in FIG. 1 taken along A-A while being released. To release the buckle 10, the buttons 46, 48 on each side 56, 58 of the receiver 14 are depressed to move the buttons 46, 48 inward against the button spring 54 to the released position. Specifically, the buttons 46, 48 are depressed inward to overcome the bias provided by the button spring 54 and move the buttons 46, 48 toward the pawls 16, 18, 20, 22. As the buttons 46, 48 move inward, they engage with the first ends 68 of the pawls 16, 18, 20, 22 to overcome the bias provided by the pawl springs 40 and pivot the pawls 16, 18, 20, 22 back into the recesses 38. Specifically, button 46 on the first side 56 of the receiver 14 pushes pawls 16 and 18 into the recesses 38, and button 48 on the second side 58 of the receiver 14 pushes pawls 20 and 22 into the recesses 38. Once the buttons 46, 48 have pushed the pawls 16, 18, 20, 22 sufficiently into the recesses 38 to clear the adjacent detent surfaces 66, the pawls 16, 18, 20, 22 are in the released position, allowing the tab 12 to be withdrawn from the receiver 14. The use of two buttons 46, 48 to reposition the pawls 16, 18, 20, 22 to the released position provides additional redundant protection against inadvertent release of the buckle 10. Specifically, both buttons 46, 48 must be simultaneously depressed to the released position to reposition all pawls 16, 18, 20, 22 to the released position to allow the tab 12 to be withdrawn from the receiver 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A buckle, comprising:

a tab having a first side opposed to a second side and a first pair of posts on the first side of the tab;

a first pair of pawls pivotally connected to the first pair of posts on the first side of the tab so that the first pair of pawls pivot around the first pair of posts;

a receiver having a first side opposed to a second side;

a cavity defined in the receiver between the first and second sides of the receiver and configured to receive the first and second sides of the tab, wherein the first pair of pawls has a locked position in which the first pair of pawls is engaged with the receiver to prevent movement of the tab with respect to the receiver and a released position in which the first pair of pawls permits movement of the tab with respect to the receiver; and a first button on the first side of the receiver, wherein the first button has a released position that moves the first pair of pawls to the released position.

2. The buckle as in claim 1, wherein each pawl in the first pair of pawls has a first end opposed to a second end, and in the locked position, the first end of each pawl is engaged with the receiver and the second end of each pawl is engaged with the tab.

3. The buckle as in claim 1, wherein the first button is biased away from the first pair of pawls.

4. The buckle as in claim 1, further comprising a projection on the tab between the first and second sides of the tab and a complementary recess defined in the receiver to receive the projection on the tab.

5. The buckle as in claim 1, further comprising a plurality of pockets defined in the tab to receive the first pair of pawls.

6. The buckle as in claim 1, further comprising a second pair of pawls pivotally connected to the second side of the tab, wherein the second pair of pawls has a locked position in which the second pair of pawls is engaged with the receiver to prevent movement of the tab with respect to the receiver and a released position in which the second pair of pawls permits movement of the tab with respect to the receiver.

7. The buckle as in claim 6, further comprising a pawl spring between adjacent pawls on the first and second sides of the tab, wherein each pawl spring biases the adjacent pawls away from one another.

8. The buckle as in claim 6, further comprising a second button on the second side of the receiver, wherein the second button has a released position that moves the second pair of pawls to the released position.

9. A buckle, comprising:

a tab;

a first pair of posts on the tab;

a first pair of pawls pivotally connected to first pair of posts on the tab so that the first pair of pawls pivot around the first pair of posts;

a second pair of pawls pivotally connected to the tab;

a receiver that defines a cavity to receive the tab, wherein the tab and the receiver have a locked position in which the first and second pairs of pawls engage with the receiver to prevent movement of the tab with respect to the receiver and a released position in which the first and second pairs of pawls permit movement of the tab with respect to the receiver; and a plurality of buttons on the receiver, wherein the plurality of buttons has a released position that moves the first and second pairs of pawls to the released position.

10. The buckle as in claim 9, wherein the plurality of buttons is biased away from the first and second pairs of pawls.

11. The buckle as in claim 9, further comprising a first pawl spring between the first pair of pawls, wherein the first pawl spring biases the first pair of pawls away from each other, and a second pawl spring between the second pair of pawls, wherein the second pawl spring biases the second pair of pawls away from each other.

12. The buckle as in claim 9, wherein each pawl in the first and second pairs of pawls has a first end opposed to a second end, and in the locked position, the first end of each pawl is engaged with the receiver and the second end of each pawl is engaged with the tab.

13. The buckle as in claim 9, further comprising a projection on the tab and a complementary recess defined in the receiver to receive the projection on the tab.

14. The buckle as in claim 9, further comprising a plurality of pockets defined in the tab to receive the first and second pairs of pawls.

15. A buckle, comprising:

a tab;

a plurality of posts on the tab;

a plurality of pawls pivotally connected to plurality of posts on the tab so that the plurality of pawls pivot around the plurality of posts;

a receiver that defines a cavity to receive the tab, wherein the tab and the receiver have a locked position in which each pawl of the plurality of pawls engages with the receiver to prevent movement of the tab with respect to the receiver and a released position in which each pawl of the plurality of pawls permits movement of the tab with respect to the receiver; and a plurality of buttons on the receiver, wherein the plurality of buttons has a released position that moves each pawl of the plurality of pawls to the released position.

16. The buckle as in claim 15, wherein each pawl in the plurality of pawls has a first end opposed to a second end, and in the locked position, the first end of each pawl is engaged with the receiver and the second end of each pawl is engaged with the tab.

17. The buckle as in claim 15, wherein the plurality of buttons is biased away from the plurality of pawls.

18. The buckle as in claim 15, further comprising a projection on the tab and a complementary recess defined in the receiver to receive the projection on the tab.

19. The buckle as in claim 15, further comprising a pocket defined in the tab to receive each pawl of the plurality of pawls.

20. The buckle as in claim 15, further comprising a pawl spring between adjacent pawls of the plurality of pawls, wherein each pawl spring biases the adjacent pawls away from one another.

* * * * *